United States Patent [19]

Fuchizawa et al.

[11] Patent Number: 4,610,956

[45] Date of Patent: Sep. 9, 1986

[54] PROCESS FOR PRODUCING SUPPORT FOR PHOTOGRAPHIC PAPER AND THE SUPPORT PRODUCED BY THE PROCESS

[75] Inventors: Tetsuro Fuchizawa; Yasuzi Asao; Takashi Takayanagi, all of Shizuoka, Japan

[73] Assignee: Fuji Photo Film Co., Ltd., Kanagawa, Japan

[21] Appl. No.: 690,027

[22] Filed: Jan. 9, 1985

[30] Foreign Application Priority Data

Jan. 9, 1984 [JP] Japan ..... 59-1666

[51] Int. Cl.[4] ..... G03C 1/76

[52] U.S. Cl. ..... 430/538; 156/242; 156/273.3; 162/136; 162/168.1; 162/192; 427/35; 427/44; 427/362; 428/537.5

[58] Field of Search ..... 156/242, 273.3; 430/271, 296, 538; 427/35, 44, 362; 162/136, 168.1, 192; 428/537.5

[56] References Cited

U.S. PATENT DOCUMENTS 3,583,881 6/1971 Kennedy ..... 427/362
4,133,710 1/1979 Wartenberg ..... 427/362
4,364,971 12/1982 Sack et al. ..... 427/44
4,384,040 5/1983 Von Meer ..... 430/935
4,521,445 6/1985 Nablo et al. ..... 427/44

*Primary Examiner*—Jack P. Brammer
*Attorney, Agent, or Firm*—Sughrue, Mion, Zinn, Macpeak and Seas

[57] ABSTRACT

A process for producing a support for photographic paper is described, having a layer hardened by irradiation with electron beams on at least one surface of the paper support, comprising coating a mixture of an organic compound capable of being hardened by irradiation with electron beams and a white pigment on a shaping face, hardening the layer by irradiation with electron beams in that state, adhering the resulting coated layer to a base paper by an adhesive, and then peeling off the base paper having the coated hardened layer from the shaping face.

A support for photographic paper is produced by the process. The support has superior properties with respect to the surface configuration and good whiteness.

20 Claims, 4 Drawing Figures

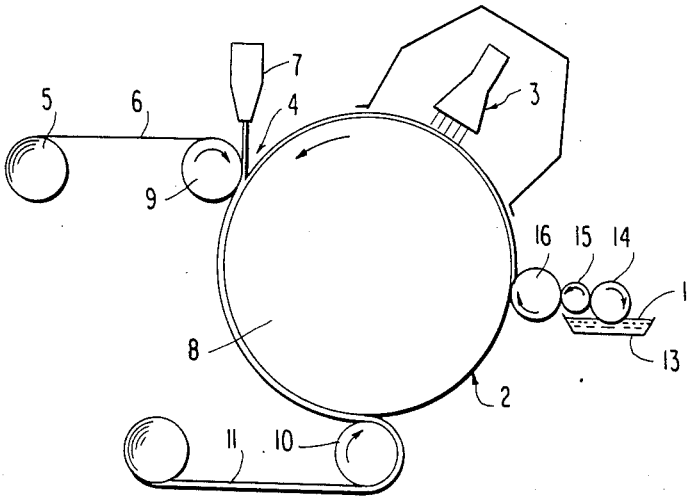
FIG. 1
FIG. 2
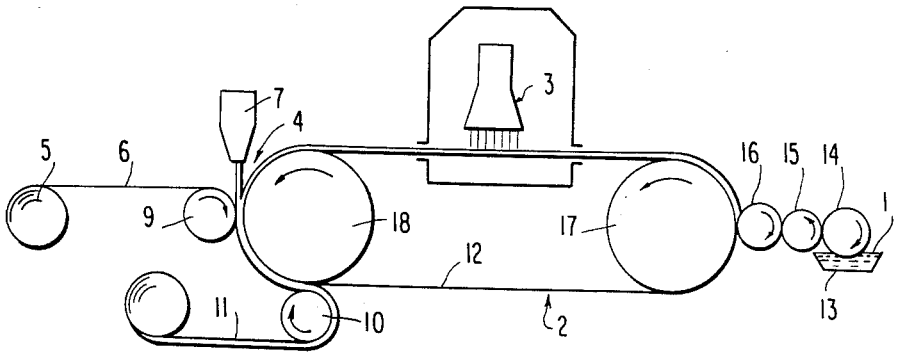
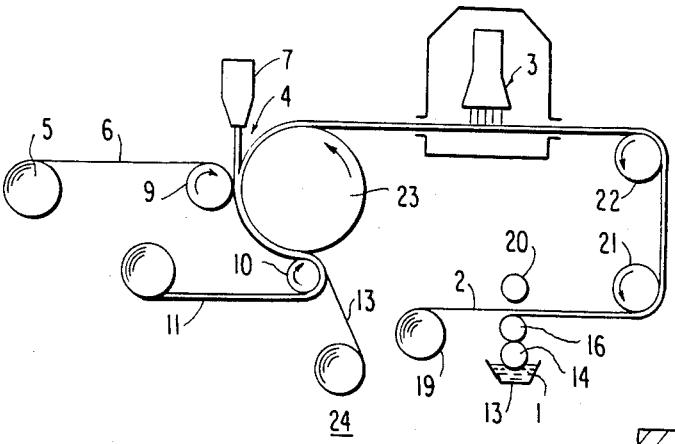
FIG. 3
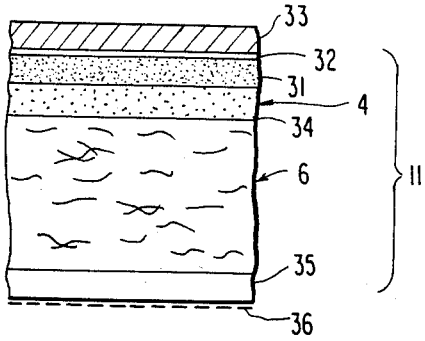
FIG. 4

PROCESS FOR PRODUCING SUPPORT FOR PHOTOGRAPHIC PAPER AND THE SUPPORT PRODUCED BY THE PROCESS

FIELD OF THE INVENTION

This invention relates to a process for producing a support for photographic paper and a support produced by the process.

BACKGROUND OF THE INVENTION

In the case of producing a support for photographic paper, it is necessary to apply a waterproofing treatment for preventing water and processing chemicals from permeating into the inside of the paper. For this purpose, the procedure that has generally been employed is to overcoat the paper with a polymer covering layer, for example, a polyolefin such as polyethylene. However, in order to improve the production efficiency and reduce the thickness of the coating layer, in order to reduce the cost in the foregoing method, it has been necessary to perform the coating by melting the polyolefin at about 300° C., and hence the polyolefin has a tendency to be thermally decomposed, which results in the occurrence of yellowing and the formation of pin holes in the coated layer. Also, in the above-described method, the dispersibility of a white pigment, which is incorporated in the polyolefin for improving the covering power, is poor, whereby the content of the white pigment is limited. In general, for example, titanium dioxide cannot be used in an amount larger than about 20% by weight. The photographic images obtained by using such a support are frequently insufficient in sharpness.

The reason for this seems to be that when the concentration of a white pigment in the coated polyolefin layer is relatively low, only a small portion of the incident light is reflected at the surface of the polyolefin layer during the light-exposure of a photographic material including said support, with the greater part of the light being scattered from the pigment particles not at the surface of the polyolefin layer, and the resulting secondary light exposure by the scattered light from said particles not at the surface reduces the sharpness of photographic images.

For overcoming the above-described problem concerning the surface structure of the support prepared by melt-coating a polyolefin containing a white pigment on a paper and the sharpness of images obtained therewith, various improvements have been proposed. For example, Japanese Patent Application (OPI) Nos. 27257/82, corresponding to U.S. Pat. No. 4,384,040, and 30830/82, corresponding to U.S. Pat. No. 4,364,971, (the term "OPI" indicates an unexamined published patent application open to public inspection) disclose a method involving coating a composition containing an organic compound having an unsaturated bond capable of being polymerized by electron beam irradiation and an inorganic white pigment on a paper support and hardening the coated layer by the irradiation of electron beam. According to the method, a waterproof paper support for photographic papers having a high content of white pigment can be obtained and hence the photographic paper having such a paper support can provide photographic images having high sharpness. Also, Japanese Patent Application (OPI) No. 30830/82 discloses a method for producing a paper support for photographic papers by coating a mixture of an organic compound capable of being hardened by irradiation with electron beam and a white pigment on a base paper, pressing the coated layer onto a high-gloss face under weak pressure, irradiating the coated layer from the back side of the paper by accelerated electron beam while maintaining a contact state of the coated layer with the high-gloss face to harden the coated layer, and then separating the paper support from the high-gloss face. By this method, a support superior in flatness and gloss to conventional polyolefin-coated paper support for photographic paper can be obtained.

Furthermore, Japanese Patent Application (OPI) No. 120934/82 discloses a method for producing a paper support for photographic paper having plastic coatings on both surfaces. The method comprises coating a polyethylene backed base paper with a mixture of an organic compound capable of being hardened by irradiation with electron beam, hardening the coated layer by the irradiation of electron beam, and forming thereon plastic layers. The paper support for photographic paper obtained by this method has good flatness and does not have adverse influences on the silver halide photographic emulsion layers formed thereon, and photographic paper having such a support gives photographic images having good quality.

However, since in these methods the electron beam are applied after coating a mixture of an organic compound capable of being hardened by the irradiation of electron beam and a white pigment on a base paper or a polyolefincoated paper, the base paper tends to be yellowed by the action of electron beam, thus reducing the whiteness and quality of photographic images formed on the paper support. Furthermore, the yellowing of the base paper further proceeds with the passage of time after the irradiation the electron beam.

SUMMARY OF THE INVENTION

The objects of this invention, therefore, include providing for a support for photographic paper having superior properties with respect to the surface configuration and good whiteness without being accompanied by yellowing of the base paper.

As the result of various investigations, the inventors have discovered that the above objects of this invention can be attained by preparing the photographic paper by a particular process. That is, according to this invention, there is provided a process for producing a support for photographic papers, comprising coating a mixture of an organic compound capable of being hardened by irradiation with electron beam and a white pigment on a shaping face, hardening the coated layer by irradiation with electron beam, adhering the resulting coated layer on a base paper with an adhesive, and then peeling off the base paper having the coated hardened layer from the shaping face.

BRIEF DESCRIPTION OF THE DRAWINGS

FIG. 1 is a schematic view showing an embodiment of the method of this invention, FIG. 2 is a schematic view showing another embodiment of this invention, FIG. 3 is a schematic view showing a still other embodiment of this invention, and FIG. 4 is a cross-sectional view showing an example of a photographic paper using a paper support obtained according to this invention.

DESCRIPTION OF THE PREFERRED EMBODIMENT

By the terminology "shaping face" as used herein is meant a substrate capable of being coated with the above-described mixture and forming a film or layer of the mixture, and examples of such a shaping face include a surface configuration of a metal drum, a metal belt, a plastic (e.g., polyester) sheet, etc.

The surface configuration of the shaping face is selected according to the desired shape of the surface of the support for photographic papers to be produced. That is, for obtaining a high-gloss surface of the support, a flat shaping face is used and for obtaining a silk fabric pattern or a mat pattern, a configuration surface having a surface pattern corresponding to the desired surface is used.

The process of this invention will be explained in further detail by referring to the embodiments of this invention shown by the accompanying drawings. In FIG. 1, FIG. 2, and FIG. 3, a mixture of an organic compound capable of being hardened by irradiation with electron beam and a white pigment is coated on a shaping face 2, after irradiating the coated layer by electron beam using an electron beam irradiating device 3, the coated film or layer is adhered to a base paper 6 supplied from a web roll 5 by an adhesive 4, and the base paper having the coated layer thereon is peeled off from the shaping face by means of a peeling roller 10 to provide a paper support 11 for photographic papers.

FIG. 1 is a schematic view showing an embodiment of this invention, wherein the shaping face is a high-gloss surface of a metal drum 8. In the embodiment shown in FIG. 1, a mixture 1 which can be hardened by the irradiation of electron beam is applied onto the shaping face 2 from a vessel 13 through a pick up roller 14, a distributing roller 15, and an applicator roller 16. Then, the coated layer is hardened by passing through an electron beam irradiation device 3 and is adhered to the base paper 6 by an adhesive 4 extruded from a die 7. In this case, a nip roller 9 contributes to adhering the base paper to the coated layer, and a metal drum 8 cooled by water and acts a cooling drum.

FIG. 2 is a schematic view showing another embodiment of this invention, wherein the shaping face 2 is the belt surface of a stainless steel endless belt 12. In this embodiment, the endless belt 12 travels endlessly around supporting drums 17 and 18. In this case, the supporting drum 18 acts as a cooling drum.

FIG. 3 is a schematic view showing still another embodiment of this invention, wherein the shaping face is the base surface of polyester base 25. The polyester base is supplied from a web roll 19 and is wound by a winder 24 through a back up roller 20 at a coating section, pass rollers 21 and 22, a cooling drum 23, and a peeling roller 10. In addition, in the aforesaid embodiment, the polyester base 13 is desirably used, but other resin bases having a desired surface aptitude can be used in place of the polyester base.

FIG. 4 is a cross-sectional view showing an example of the sectional structure of a photographic paper using a paper support 11 obtained by the method of this invention. In the example shown in FIG. 4, a layer hardened by irradiation with electron rays is formed on a base paper 6 by means of an adhesive 4 and a silver halide photographic emulsion layer 33 is formed thereon through a gelatin layer or an oxidized surface 32. In addition, in the embodiment of FIG. 4, an oxidized surface 34 is formed on the base paper 6 and on the back side of the base paper 6 are formed a back seal layer 35 (a polyethylene layer or a layer hardened by the irradiation of electron beam) and a layer 36 containing an antistatic agent and/or a writability imparting agent. Numeral 11 shows the paper support.

The base paper coated with the high-gloss layer at one surface thereof is also coated with a waterproof resin at the other surface in another step. Such a "backing" layer can be formed by an optional method using an optional material as long as the layer shows a water resisting property to processing liquids. For example, the backing layer may be formed by coating a molten polyethylene or an organic compound layer hardened by irradiation of electron beam may be formed as the back layer. In the case of forming the organic compound layers hardened by the irradiation of electron beam on both the surfaces of a base paper, the layers may be successively formed on both the surface of the base paper by the method of this invention using a accelerator for hardening the layer.

In these cases, that is, in the case of adhering the layer or layers hardened by the irradiation of electron rays to the surface or surfaces of a base paper, the adhering operation is preferably performed under pressure by a nip roll for preventing the entrance of bubbles.

For obtaining a support for photographic papers having a slik fabric pattern or a mat pattern, a drum or a stainless belt wherein a desired pattern is engraved on the surface thereof may be used.

As organic compounds hardenable by the irradiation with electron beam, various known compounds can be used, and particularly preferred compounds in this invention include compounds having an unsaturated bond polymerizable by irradiation with electron beam, such as, for example, compounds each having, preferably, plural vinyl or vinylidene carbon-carbon double bonds. For example, there are compounds containing an acryloyl group, an acrylamido group, an allyl group, a vinylether group, a vinylthioether group, etc., and unsaturated polyesters, etc.

Particularly preferred compounds of the foregoing compounds having the unsaturated bonds are compounds having acryloyl groups or methacryloyl groups at both terminals of the straight chain of the compound. These compounds are described, for example, in A. Vrancken; *Fatipec Congress.* 1119 (1972). For example, a practical example of such a compound is $$CH_2{=}CH{-}CO_2{-}CH_2{-}\underset{\underset{OH}{|}}{CH}CHO\left(COCH_2CH_2CO_2CH_2\underset{\underset{OH}{|}}{CH}CH_2O\right)_n COCH{=}CH_2.$$

The polyester skeleton of the compound illustrated above may be replaced by a polyurethane skeleton, an epoxy resin skeleton, a polyether skeleton, a polycarbonate skeleton or a combination of these skeletons. Also, the terminal groups of the illustrated compound may be replaced with methacryloyl groups. Also, it is preferred that the molecular weight of the compounds be from about 500 to about 20,000.

Such compounds are also commercially available, e.g., as Arrownix M6100, M7100, etc., made by Toagosei Chemical Industry Co., Ltd.

Furthermore, a monomer having an unsaturated carbon-carbon bond in the molecule and/or an organic solvent may be used together with the foregoing compound. Such a monomer includes, for example, acrylic acid, methacrylic acid, itaconic acid, methyl acrylate (and homologs thereof, acrylic acid alkyl esters), methyl methacrylate (and homologs thereof, methacrylic acid esters), styrene (and homologs thereof, α-methylstyrene, β-chlorostyrene, etc.), acrylonitrile, methacrylonitrile, acrylamide, methacrylamide, vinyl acetate, vinyl propionate, etc. The monomer may have two or more unsaturated bonds in the molecule. Examples of these compounds are described, e.g., in *Kankosei Jushi Data* (*Data of Photosensitive Resins*), pages 235–236, published by K. K. Sogo Kagaku Kenkyusho, December, 1968. Particularly preferred monomers are unsaturated esters of polyols, such as ethylene glycol diacrylate, butoxyethyl acrylate, 1,4-butanediol diacrylate, 1,6-hexanediol acrylate, stearyl acrylate, 2-ethylhexyl acrylate, diethylene glycol diacrylate, diethylene glycol dimethacrylate, tetraethylene glycol diacrylate, glycerol trimethacrylate, trimethylolpropane triacrylate, pentaerythritol triacrylate, ethylene glycol dimethacrylate, pentaerythritol tetramethacrylate, etc., and glycidyl methacrylate having an epoxy ring. A mixture of the monomer having one unsaturated bond in the molecule and the monomer having two or more unsaturated bonds in the molecule may be used.

In the case of adding the monomer of the above-described polymer or oligomer hardenable by the irradiation of electron beam, the ratio of the polymer (and/or the oligomer)/the monomer is preferably higher than 2/8, and if the ratio is outside the aforesaid range, a large amount of energy is required for hardening.

Also, the compound or composition which is hardened by the irradiation of electron beam may further contain, if desired, a thermoplastic resin such as a vinyl chloride/vinyl acetate copolymer, a cellulose series resin, an acetal series resin, a vinyl chloride-vinylidene chloride series resin, a urethane resin, an acrylonitrile butadiene resin, etc., solely or as a mixture thereof.

White pigments which can be incorporated in the layer, include $TiO_2$, ZnO, $SiO_2$, $BaSO_4$, $CaSO_4$, $CaCO_3$, talc, clay, etc., but other inorganic white pigments may be also used. Also, if desired, other colored pigment may be used together with the white pigment. The content of the white pigment is generally selected in the range of from 20 to 90% by weight (based on the total weight of the mixture) and is preferably about 50% by weight. The coated amount (coverage) of the coated layer is generally from 5 to 100 g/m$^2$, preferably from 5 to 50 g/m$^2$, and is more preferably from 5 to 20 g/m$^2$ from the viewpoint of sharpness of images in the white pigment.

In the case of kneading the above-described components for providing the composition hardenable by the irradiation of electron beam, these components are supplied into a kneader simultaneously or successively. Also, a dispersing agent may be added to the composition together with a white pigment.

Various types of kneaders are used for kneading the above-described components. For example, there are a two roll mill, a three roll mill, a ball mill, a pebble mill, a trommel, a sand grinder, a Szegvari attritor, a high-speed impeller dispersing machine, a high-speed stone mill, a high-speed impact mill, a kneader, a high-speed mixer, a homogenizer, a ultrasonic dispersing machine, etc.

Techniques of kneading dispersion are described, for example, in T. C. Patton; *Paint Flow and Pigment Dispersion;* published by John Wiley & Sons Co., 1964. Also, these techniques are described in U.S. Pat. Nos. 2,581,414 and 2,855,156.

The coating composition described above can be coated on a base by an air doctor coating method, a blade coating method, an air knife coating method, a squeeze coating method, a reverse roll coating method, a transfer roll coating method, a gravure coating method, a kiss coating method, a cast coating method, a spray coating method, a spin coating method, etc., and such methods are practically described, for example, in *Coating Engineering,* pages 253–277, published by Asakura Shoten, March 1971.

As an electron accelerator, a van de Graaff type scanning accelerator, a double scanning accelerator, or a curtain beam accelerator can be employed, with a curtain beam accelerator, which is relatively inexpensive and gives a large output, being preferred. As to the electron beam characteristics, the acceleration voltage is generally from 100 to 1,000 KV, and preferably from 100 to 300 KV, and the absorption dose is generally from 0.5 to 20 mega rads, and preferably from 2 to 10 mega rads. If the acceleration voltage is lower than 100 KV, the penetration amount of energy tends to become insufficient, and if the voltage is over 1,000 KV, the energy efficiency of the polymerization is reduced, which is economically undesirable. Also, if the absorption dose is less than 0.5 mega rads, the hardening reaction tends to be limited, whereby a desired good quality is not obtained, while if the dose is higher than 20 mega rads, the energy efficiency of the hardening is reduced and also the irradiated material generates heat, which are undesirable.

There is no particular restriction on the adhesives for adhering the coated layer hardened by the irradiation of electron beam to a base paper and adhesives having an adhesive strength of not peeling the coated layer from the base paper during the production steps of the support, coating steps of photographic emulsions and processing steps for the photographic materials. For example, urea resin adhesives, melamine resin adhesives, phenol resin adhesives, vinyl acetate solution type adhesives, vinyl acetate emulsion type adhesives, etc., can be used, but hot melt type adhesives are particularly effective. Useful hot melt type adhesives include polyolefins, ethylene-vinyl acetate copolymers, ethylene-acrylate copolymers, ethylene-isobutyl acrylate copolymers, polyamide series adhesives, butyral series adhesives, vinyl acetate-crotonic acid copolymers, vinyl acetate-phthalic anhydride copolymers, cellulose derivative adhesives, polyester series adhesives, polymethyl methacrylate series adhesives, polyvinyl ether series adhesives, polyurethane series adhesives, etc. Polyethylene is particularly preferred as the polyolefins. In the case of employing polyethylene as the adhesives, the polymer is melted at 300° C.±20° C. and extruded onto the base paper through a slit nozzle.

The adhesive layer such as, for example, a polyolefin layer as the adhesive layer, may contain up to 20% by weight of a white pigment, such as preferably rutile type or anataze type titanium dioxide. In this case, zinc oxide and/or calcium carbonate may be used together with titanium dioxide. The polyolefin layer may further contain a small amount of a colored pigment for controlling the color hue. Furthermore, the polyolefin layer may contain other additives such as a fluorescent brightening agent, a dispersing agent, etc.

The base paper may is usually subjected to a surface treatment such as a corona discharging treatment, a flame treatment, etc., before the application of the adhesive such as molten polyolefin, etc., to increase the adhesive strength with the polyolefin layer.

It is preferred that the base paper for use as the support is acid sized by a fatty acid soap, a fatty acid anhydride, etc., or neutrally sized by an alkylketone dimer, etc. The base paper can contain a dry paper strength increasing agent, a wet paper strength increasing agent, a fluorescent brightening agent, a coloring agent, a pigment, etc. It is advantageous that the base paper be surface sized by a water-soluble binder or a water-dispersible binder. The surface size layer can contain a water repellent, an antistatic agent, a fluorescent brightening agent, a coloring agent, a pigment, etc. There is no particular restriction on the weight of the base paper, but the weight of the base paper is usually from 60 to 250 g/m$^2$, and preferably from 80 to 200 g/m$^2$. The base paper may be manufactured solely from natural cellulose fibers, or from a mixture of natural cellulose fibers and synthetic fibers.

The layer hardened by the irradiation of electron beam, after peeling off from the shaping face, is usually subjected to a known surface treatment, such as a corona discharging treatment, a flame treatment, etc. A surface treatment by ozone or various wet chemical surface oxidations (as described, e.g., in U.S. Pat. No. 3,317,330), or a ultraviolet irradiation treatment is applicable. Therefore, a gelatin may be coated on the layer before coating silver halide photographic emulsion.

Also, to the backing layer (i.e., the polyolefin layer or a layer hardened by irradiation with electron beam) of the support thus prepared may be applied an antistatic agent or a writability-imparting agent (e.g., pigment in binder).

The invention is explained in more detail by the following example.

EXAMPLE 1

A mixture of an organic compound capable of being hardened by the irradiation of electron beam and a white pigment was coated on a high-gloss metal drum by means of a transfer roll coating method. The composition of the mixture of the organic compound and the white pigment was as follows.

| Composition A: | |
|---|---|
| Polyester acrylate (having molecular weight of about 1,000 and four double bonds per molecule) | 25% by weight |
| Trimethylolpropane triacrylate | 25% by weight |
| Titanium dioxide (rutile type) | 50% by weight |

The coated amount was 20 g/m$^2$. Thereafter, the layer thus formed was irradiated by electron beam on the metal drum at an acceleration voltage of 200 KV and an absorption dose of 10 mega rads.

Then, the hardened layer was peeled off from the metal drum and stuck to a base paper having a weight of 170 g/m$^2$ and a reflectance of 102% at 440 m$\mu$, adjusted by using a fluorescent brightening agent having the structure

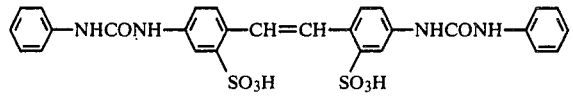

using molten polyethylene having the following composition as an adhesive by the manner shown in FIG. 1.

| Composition B: | |
|---|---|
| Low density polyethylene (having density of 0.92 and melt index of 3) | 90% by weight |
| Titanium dioxide (anataze type) | 10% by weight |

That is, the above-described adhesive composition was pre-mixed in a Banbury mixer and then extruded at 290° C. and at a thickness of 20 $\mu$m by means of an extruding machine. Then, the base paper having the layer hardened by the irradiation of electron beam was peeled off from the metal drum. Then, the uncoated back surface of the base paper was coated with a polyethylene mixture having the following composition at a thickness of 30 $\mu$m to provide Sample No. 1.

| Composition C: | |
|---|---|
| High density polyethylene (having density of 0.96 and melt index of 10) | 70% by weight |
| Low density polyethylene (having density of 0.92 and melt index of 3) | 30% by weight |

COMPARATIVE EXAMPLE 1

Polyethylene having the same composition as Composition B in Example 1 was extruded at 290° C. and at a thickness of 20 $\mu$m and melt-coated on the surface of the base paper as in Example 1. Then, a mixture (Composition A in Example 1) of the organic compound hardenable by the irradiation of electron beam and the white pigment was coated on the polyethylene layer of the base paper at a coverage of 20 g/m$^2$. Then, the base paper having the coated layers was pressed onto a high-gloss metal drum surface and then the coated layers were irradiated by electron beam in the coated state from the back side of the paper at an acceleration voltage of 200 KV and an absorption dose of 10 mega rads. Then, the uncoated back surface of the base paper was coated with polyethylene having the same composition as Composition C in Example 1 at a thickness of 30 $\mu$m to provide Sample No. 2.

The spectral reflectance at 440 nm of each of these samples and each of the base papers obtained by peeling off the polyethylene layer from each sample was measured by a Hitachi Color Analyzer Type 607 (made by Hitachi, Ltd.). The results are shown in Table 1.

TABLE 1

| | Reflectance at 440 nm of Sample | | Reflectance at 440 nm of Base Paper after Peeling of Polyethylene Layer | |
|---|---|---|---|---|
| Sample | Directly after Formation of Sample | 6 Months after Formation | Directly after Formation of Sample | 6 Months after Formation |
| No. 1 | 88.0% | 87.7% | 102.0% | 101.4% |
| No. 2 | 86.2% | 83.5% | 94.4% | 87.4% |

As is clear from the results shown in Table 1, the reflectance at 440 nm of Sample No. 1 is higher than that of Sample No. 2 and the reduction of the reflectance at 440 nm overtime is lower for Sample No. 1 than for Sample 2. This is because the reflectance at 440 nm of the base paper of Sample No. 2 is reduced due to irradiation by electron beam, as well as the reduction of the reflectance with the passage of time being severe for Sample No. 2.

As described above, according to this invention, a support for photographic papers having a high spectral reflectance and good whiteness can be obtained. Also, by selecting the shaping face, a support for photographic papers having a gloss surface, a silk fabric pattern, or a mat pattern surface can be obtained.

While the invention has been described in detail and with reference to specific embodiment thereof, it will be apparent to one skilled in the art that various changes and modifications can be made therein without departing from the spirit and scope thereof.

What is claimed is:

1. A process for producing a support for a photographic paper having a layer hardened by irradiation with an electron beam on at least one surface of the support comprising: (1) coating a mixture of (a) an organic compound capable of being hardened by irradiation with an electron beam and (b) a white pigment, on a shaping face to form a layer of said mixture, (2) hardening the layer by irradiation with an electron beam in that state, (3) providing an adhesive layer on the hardened layer, (4) adhering the resulting hardened layer to a base paper through the use of said adhesive layer, and (5) then peeling off the resulting base paper, having thereon the hardened layer, from the shaping face to form said support.

2. A process for producing a support for a photographic paper as in claim 1, wherein molten polyethylene is used as the adhesive.

3. A process for producing a support for a photographic paper as in claim 1, wherein the organic compound capable of being hardened by the irradiation with an electron beam is a compound having plural vinyl or vinylidene carbon-carbon double bonds.

4. A process for producing a support for a photographic paper as in claim 1, wherein the organic compound capable of being hardened by the irradiation with an electron beam is a compound having acryloyl groups or methacyloyl groups at the terminals of the straight chain of the compound.

5. A process for producing a support for a photographic paper as in claim 1, wherein the white pigment is at least one member selected from the group consisting of titanium dioxide, zinc oxide, silicon dioxide, barium sulfate, calcium sulfate, calcium carbonate, talc, and clay.

6. A process for producing a support for a photographic paper as in claim 5, wherein the white pigment is titanium dioxide.

7. A process for producing a support for a photographic paper as in claim 1, wherein the shaping face is a metal drum, a metal belt, or a plastic sheet.

8. A process for producing a support for a photographic paper as in claim 1, wherein the content of the white pigment is selected in the range of from 20 to 90% by weight.

9. A process for producing a support for a photographic paper as in claim 1, wherein the coated amount of the white pigment is from 5 to 100 g/m$^2$.

10. A process for producing a support for a photographic paper as in claim 1, wherein molten polyethylene is used as the adhesive, the organic compound capable of being formed by the irradiation of electron beams is a compound having plural vinyl or vinylidene carbon-carbon double bonds, the white pigment is at least one member selected from the group consisting of titanium dioxide, zinc oxide, silicon dioxide, barium sulfate, calcium sulfate, calcium carbonate, talc, and clay, and the shaping face is a metal drum, a metal belt, or a plastic sheet.

11. A support for a photographic paper having a layer hardened by irradiation with an electron beam on at least one surface of the support prepared by the method comprising: (1) coating a mixture of (a) an organic compound capable of being hardened by irradiation with an electron beam and (b) a white pigment, on a shaping face to form a layer of said mixture, (2) hardening the layer by irradiation with an electron beam in that state, (3) providing an adhesive layer on the hardened layer, (4) adhering the resulting hardened layer to a base paper through the use of said adhesive layer, and (5) then peeling off the resulting base paper, having thereon the hardened layer, from the shaping face to form said support.

12. A support for a photographic paper as in claim 11, wherein molten polyethylene is used as the adhesive.

13. A support for a photographic paper as in claim 11, wherein the organic compound capable of being hardened by the irradiation with an electron beam is a compound having plural vinyl or vinylidene carbon-carbon double bonds.

14. A support for a photographic paper as in claim 11, wherein the organic compound capable of being hardened by the irradiation with an electron beam is a compound having acryloyl groups or methacyloyl groups at the terminals of the straight chain of the compound.

15. A support for a photographic paper as in claim 11, wherein the white pigment is at least one member selected from the group consisting of titanium dioxide, zinc oxide, silicon dioxide, barium sulfate, calcium sulfate, calcium carbonate, talc, and clay.

16. A support for a photographic paper as in claim 15, wherein the white pigment is titanium dioxide.

17. A support for a photographic paper as in claim 11, wherein the shaping face is a metal drum, a metal belt, or a plastic sheet.

18. A support for a photographic paper as in claim 11, wherein the content of the white pigment is selected in the range of from 20 to 90% by weight.

19. A support for a photographic paper as in claim 11, wherein the coated amount of the white pigment is from 5 to 100 g/m$^2$.

20. A support for a photographic paper as in claim 11, wherein molten polyethylene is used as the adhesive, the organic compound capable of being formed by the irradiation of electron beams is a compound having plural vinyl or vinylidene carbon-carbon double bonds, the white pigment is at least one member selected from the group consisting of titanium dioxide, zinc oxide, silicon dioxide, barium sulfate, calcium sulfate, calcium carbonate, talc, and clay, and the shaping face is a metal drum, a metal belt, or a plastic sheet.

* * * * *